US007415937B2

(12) United States Patent
Giesler et al.

(10) Patent No.: US 7,415,937 B2
(45) Date of Patent: Aug. 26, 2008

(54) SELF-CONTAINED SEA WATER LINEAR ACTUATOR

(75) Inventors: William L. Giesler, Phoenix, AZ (US); Louie T. Gaines, Phoenix, AZ (US); Jeff C. Philips, Chandler, AZ (US)

(73) Assignee: Honeywell International Inc., Morristown, NJ (US)

( * ) Notice: Subject to any disclaimer, the term of this patent is extended or adjusted under 35 U.S.C. 154(b) by 1 day.

(21) Appl. No.: 11/588,896

(22) Filed: Oct. 27, 2006

(65) Prior Publication Data

US 2008/0098944 A1 May 1, 2008

(51) Int. Cl.
*B63G 8/00* (2006.01)

(52) U.S. Cl. ..... 114/312

(58) Field of Classification Search ..... 114/312
See application file for complete search history.

(56) References Cited

U.S. PATENT DOCUMENTS 3,591,188 A 7/1971 Eisner
4,466,619 A 8/1984 Adams
4,629,196 A 12/1986 Joniec
4,858,937 A 8/1989 Fairlie-Clarke et al.
5,249,812 A 10/1993 Volden et al.
5,562,406 A 10/1996 Ooka et al.
5,632,411 A * 5/1997 Harty et al. ..... 222/1
5,727,792 A 3/1998 Rockwood
6,416,057 B1 7/2002 Adams et al.
7,014,192 B2 3/2006 Takahashi et al.
7,093,820 B2 8/2006 Anderson et al.
2003/0131566 A1 * 7/2003 Glucksman et al. ..... 53/432
2005/0230652 A1 10/2005 Anderson et al.
2005/0235898 A1 * 10/2005 Hobson et al. ..... 114/312

* cited by examiner

*Primary Examiner*—Stephen Avila
(74) *Attorney, Agent, or Firm*—Ingrassia, Fisher & Lorenz, P.C.

(57) ABSTRACT

An actuator that at least inhibits the deleterious effects of corrosive fluids, such as seawater, does not rely on relatively expensive materials, and is capable of operation and relatively high pressures includes two sealed buffer chambers. One buffer chamber is supplied with a buffer fluid, and the other buffer chamber is maintained at a vacuum pressure. The buffer fluid in the first buffer chamber helps remove any residual corrosive fluid that may remain on the actuator translation member as it moves into the actuator housing, and any fluid that leaks into the second chamber will boil as a result of the vacuum pressure therein.

18 Claims, 4 Drawing Sheets

SELF-CONTAINED SEA WATER LINEAR ACTUATOR

TECHNICAL FIELD

The present invention relates to linear actuators and, more particularly, to a linear actuator that includes a seal system for isolating at least portions of the actuator from a corrosive fluid, such as seawater.

BACKGROUND

Actuators are used in myriad devices and systems. For example, many vehicles including, for example, aircraft, spacecraft, watercraft, and numerous other terrestrial and non-terrestrial vehicles, include one or more actuators to effect the movement of various control surfaces or components. In many applications such as, for example, in seagoing vehicles, the actuators that are used may be subject to corrosive fluid, such as seawater. Moreover, depending on the type of seagoing vehicle, the actuators that are used may be subject to relatively high pressure. For example, underwater vehicles, including both manned and autonomous (i.e., unmanned) underwater vehicles, include actuators that may be at least partially exposed to the corrosive seawater environment at relatively high pressures.

To prevent or at least inhibit the potentially deleterious effects of seawater corrosion, actuators may be constructed, at least partially, of various corrosion resistant materials. These materials, however, can be relatively expensive, and thus can increase actuator costs and, concomitantly, overall system and/or vehicle costs. Moreover, the use of corrosion resistant materials for gears and bearings can decrease load capacity and/or component life, as compared to the use of non-corrosion-resistant materials. Although various seals and seal systems exist for inhibiting the ingress of fluids, such as seawater, into devices, such as actuators, many of these seals and seal systems are not useful at relatively high pressures. Additionally, seal leakage may increase over time.

Hence, there is a need for a system that at least inhibits the deleterious effects of corrosive fluids on an actuator that does not rely on one or more relatively expensive materials and/or is capable of operation and relatively high pressures for relatively long periods of exposure to a corrosive fluid, such as seawater. The present invention addresses at least these needs.

BRIEF SUMMARY

In one embodiment, and by way of example only, an actuation system includes an actuator housing, a translation member, a plurality of seals, a pressurized buffer fluid source, and a vacuum pressure source. The translation member is disposed within the actuator housing, is adapted to receive a drive force, and is operable upon receipt of the drive force to translate between a retracted position and an extended position. The plurality of seals are disposed between the actuator housing and the translation member, and define at least a first buffer chamber and a second buffer chamber. The pressurized buffer fluid source is in fluid communication with the first buffer chamber and is operable to supply a pressurized buffer fluid thereto. The vacuum pressure source is in fluid communication with the second buffer chamber, to thereby maintain the second buffer chamber at least at a vacuum pressure.

In another exemplary embodiment, an actuation system includes an actuator housing, a translation member, a plurality of seals, and a reverse osmosis system. The translation member is disposed within the actuator housing, is adapted to receive a drive force, and is operable upon receipt of the drive force to translate between a retracted position and an extended position. The plurality of seals are disposed between the actuator housing and the translation member, and define at least a first buffer chamber and a second buffer chamber. The reverse osmosis system is at least partially mounted on the actuator housing, is in fluid communication with the first buffer chamber, and is operable to supply a pressurized buffer fluid to the first buffer chamber.

In yet another exemplary embodiment, an actuation system includes an actuator housing, a translation member, a plurality of seals, and a vacuum pump. The translation member is disposed within the actuator housing, is adapted to receive a drive force, and is operable upon receipt of the drive force to translate between a retracted position and an extended position. The plurality of seals are disposed between the actuator housing and the translation member, and define at least a first buffer chamber and a second buffer chamber. The vacuum pump has at least an inlet in fluid communication with the second buffer chamber, and is operable to maintain the second buffer chamber at least at a vacuum pressure Other independent features and advantages of the preferred actuation system will become apparent from the following detailed description, taken in conjunction with the accompanying drawings which illustrate, by way of example, the principles of the invention.

DETAILED DESCRIPTION OF A PREFERRED EMBODIMENT

The following detailed description is merely exemplary in nature and is not intended to limit the invention or the application and uses of the invention. Furthermore, there is no intention to be bound by any theory presented in the preceding background or the following detailed description. In this regard, although the actuator is described herein as being implemented with a seagoing unmanned underwater vehicle (UUV), it will be appreciated that it may be implemented in various other vehicles and/or various other environments.

Figure 1:
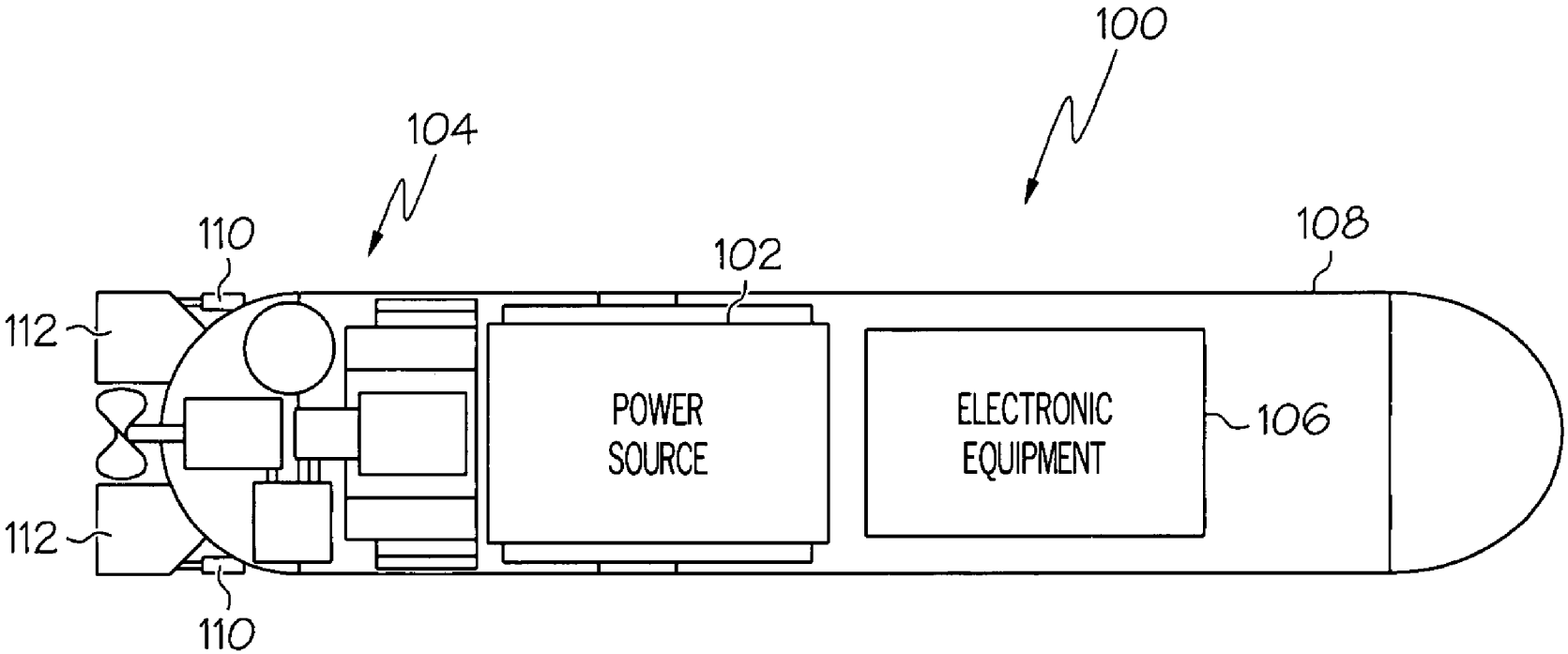
FIG. 1 is a simplified functional block diagram representation of an exemplary unmanned underwater vehicle (UUV)

An exemplary embodiment of an unmanned underwater vehicle (UUV) 100 is shown in FIG. 1, and includes a power source 102, a power plant 104, and on-board electronic equipment 106, all housed within a hull 108. The power source 102 is a rechargeable power source and is used to supply power to the power plant 104. The power source 102 may be any one of numerous types of rechargeable power sources such as, for example, a rechargeable heat source for driving a closed Brayton cycle (CBC), and/or a battery. If a rechargeable heat source is used, it may be any one of numerous types of rechargeable heat sources such as, for example, a porous solid or a molten salt. Similarly, if a battery is used, it may be any one of numerous types of rechargeable batteries such as, for example, a lead-acid battery, a nickel-cadmium battery, or a lithium battery.

The power plant 104 uses the power supplied from the power source 102 to generate propulsion power and electrical power for the UUV 100. Thus, the power plant 104 preferably includes one or more turbines, generators, and/or motors to supply the needed propulsion and electrical power. It will be appreciated that the particular number, type, and configuration of equipment and components used to implement the power plant 104 may vary depending on the specific power source 102 that is used.

The on-board electronic equipment 106 may also vary, depending on the purpose and mission of the UUV 100, the configuration of the power source 102, and/or the configuration of the power plant 104. No matter the particular type of electronic equipment 106 that is used, or its particular configuration, the on-board electronic equipment 106 is preferably configured to supply commands to various devices and systems, and to gather and store data regarding various devices and systems on-board the UUV 100. The on-board electronic equipment 106 is also preferably configured to transmit some or all of the data it gathers and stores to, and/or to receive various types of data from, a remote station (not illustrated).

Included among the various devices to which the on-board electronic equipment supplies commands are various actuators 110. For example, as depicted in FIG. 1, various actuators 110 may be coupled to various control surfaces 112 on the UUV hull 108. The control surfaces 112, as is generally known, are used to maneuver the UUV 100. As FIG. 1 also depicts, some of the actuators 110 may be disposed, either wholly or partially, external to the hull 108, and thus exposed to the surrounding seawater environment 114. Thus, at least the actuators 110 that are so exposed are configured to at least inhibit seawater ingress. Various preferred configurations for doing so will now be described.

Figure 2:
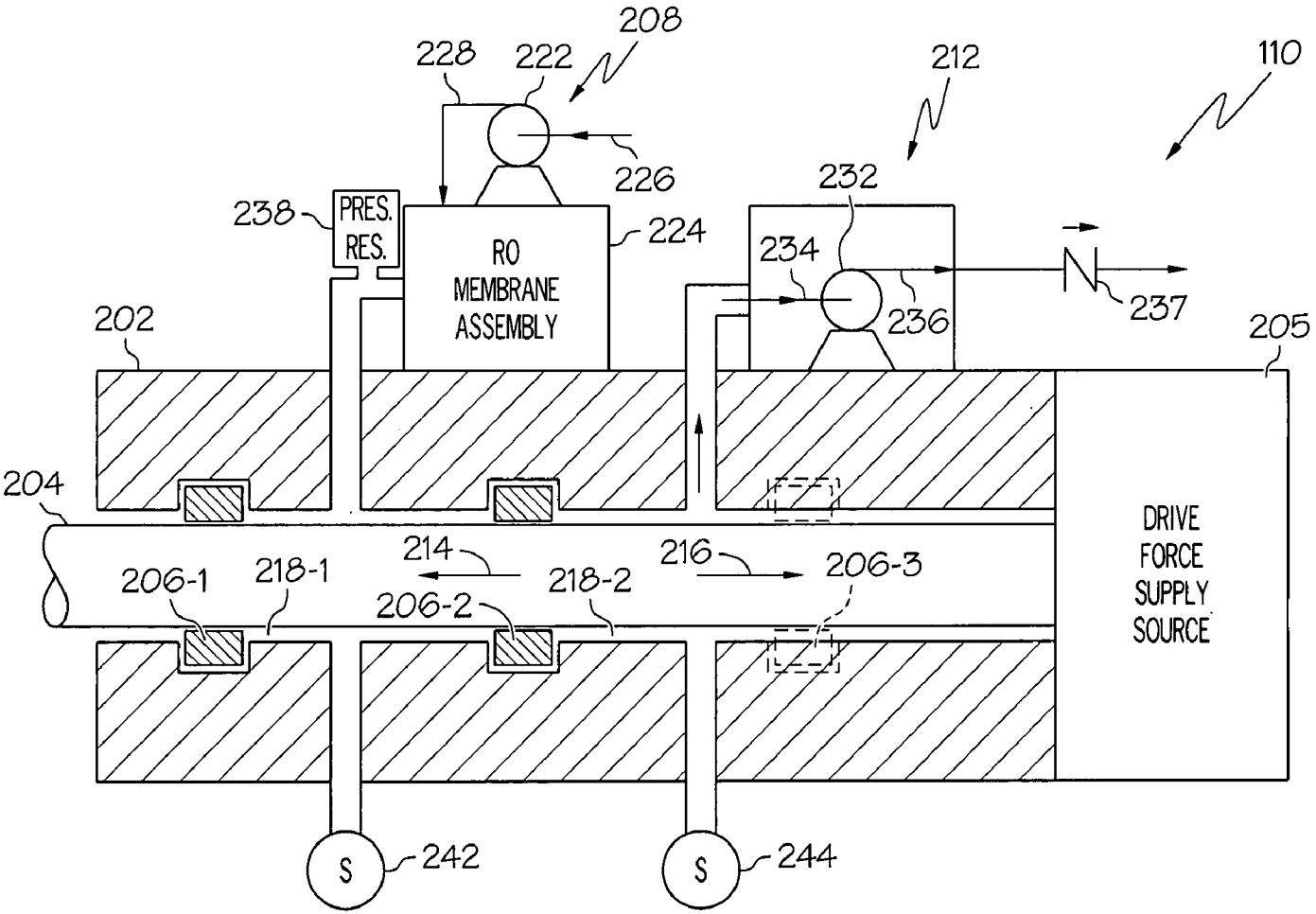
FIGS. 2-4 are simplified schematic cross section views of various exemplary self-contained actuators that may be used to, for example, manipulate various components on, or within, the UUV of FIG. 1 or in any one of numerous other potentially corrosive environments.

Referring first to FIG. 2, which depicts a simplified cross section view of a portion of an exemplary actuator 110, it is seen that the actuator 110 includes at least an actuator housing 202, a translation member 204, a plurality of seals 206 (e.g., 206-1, 206-2, 206-3), a pressurized buffer fluid source 208, and a vacuum pressure source 212. The translation member 204 is movably disposed within the housing 202 and is coupled to receive a drive force from a drive force supply source 205 and is configured, upon receipt of the drive force, to translate in either a first direction 214 or a second direction 216. It will be appreciated that movement of the translation member 204 in either the first or second directions 214, 216 results in appropriate movement of a non-illustrated component, such as a UUV control surface 112, to which the translation member 202 is coupled. It will be appreciated that the drive force may be supplied to the translation member 204 from any one of numerous electrical, pneumatic, or hydraulic sources. For example, and as will be described in more detail further below, the drive force supply source 205 may be an electric, pneumatic, or hydraulic motor and one or more intervening devices, or a pressurized pneumatic or hydraulic fluid.

The plurality of seals 206 are disposed between the actuator housing 202 and the translation member 204, and define a plurality of buffer chambers 218 (e.g., 218-1, 218-2). In the depicted embodiment, the actuator 110 includes at least a first seal 206-1, a second seal 206-2, and a third seal 206-3 that together define at least a first buffer chamber 218-1 and a second buffer chamber 218-2. It will be appreciated that this number of seals 206 and buffer chambers 218 is merely exemplary, and that other numbers of seals 206 and buffer chambers 218 could be implemented. For example, as will be described further below, in one or more exemplary alternative embodiments, the third seal 206-3 is not included.

No matter the specific number of seals 206 that are used, it will additionally be appreciated that each seal 206 may be implemented using any one, or combination, of numerous seals. In a particular preferred embodiment, the first seal 206-1 is implemented using a scraper seal and one or more low leakage seals, and the second and third seals 206-2, 206-3 are each implemented using one or more low leakage seals. Although the particular type of low leakage seal may vary, in a particular preferred embodiment, each low leakage seal is implemented using any one of the numerous low leakage seals disclosed in U.S. Pat. No. 7,093,820, entitled "Over Center High Deflection Pressure Energizing Low Leakage Seal," and assigned to the assignee of the instant invention. Some examples of alternative seal types include, but are not limited to, elastomeric O-ring seals, elastomeric O-rings with high pressure backup rings, plastic cap elastomer energized seals, plastic wedge elastomer energized seals, plastic backup T elastomer energized seals, and plastic C-section seals with metallic energizers.

The first seal 206-1, as just noted, is preferably implemented using both a scraper seal and one or more low leakage seals. These seals work together to not only inhibit seawater leakage into the actuator housing 110, but also help remove seawater from those portions of the translation member 204 exposed to seawater, as those portions of the translation member 204 translate back into the actuator housing 110. As may be appreciated, even after traversing past the first seal 206-1, some seawater may remain on the translation member 204. However, buffer fluid supplied to the first buffer chamber 218-1 will remove this residual seawater. The buffer fluid supplied to the first buffer chamber 218-1 is supplied from the pressurized buffer fluid source 208, which will now be described.

The pressurized buffer fluid source 208 may be implemented using any one of numerous devices and/or systems for supplying non-seawater, relatively low corrosion fluid at a pressure greater than the pressure in the surrounding seawater environment 114. In the depicted embodiment, the pressurized buffer fluid source 208 is a reverse osmosis system that includes a pump 222 and a reverse osmosis membrane assembly 224. The pump 222 includes a fluid inlet 226 and a fluid outlet 228. The fluid inlet 222 is in fluid communication with the surrounding seawater environment 114. Thus, when the pump 222 is operating, it draws seawater from the surrounding environment 114 into the fluid inlet 226 and discharges the seawater at a higher pressure out the fluid outlet 228 and into the reverse osmosis membrane assembly 224.

The reverse osmosis membrane assembly 224 is in fluid communication with both the reverse osmosis pump fluid outlet 228 and the first buffer chamber 218-1, and thus receives the seawater discharged from the reverse osmosis pump 222. A reverse osmosis membrane assembly 224, as is generally known, removes a solute from a solution that is supplied thereto. In the depicted embodiment, in which the solution is seawater, the solute that the reverse osmosis membrane assembly 224 removes is at least salt. After the seawater is desalinated by the reverse osmosis membrane assembly 224, the desalinated water is supplied to the first buffer chamber 218-1. As was noted above, the pump 222 supplies seawater to the reverse osmosis membrane assembly 224 at a pressure higher than the surrounding seawater environment 114. Thus, the pressure of the desalinated water supplied to the first buffer chamber 218-1 exceeds that of the surrounding seawater environment 114, further inhibiting seawater corrosive salt ingress to the actuator housing 202.

Preferably, the pump 222 and reverse osmosis membrane assembly 224 are both mounted on the actuator housing 202. It will be appreciated, however, that this is merely exemplary, and that one or both of these could be mounted remote from the actuator housing 202. It will additionally be appreciated that in some embodiments, the pressurized buffer fluid source 208 may be configured such that the buffer fluid supplied to the first buffer chamber 218-1 includes an anti-freeze compound. The specific anti-freeze compound may vary, and may be, for example, a glycol or any one of numerous other known anti-freeze compounds, or it may be a non-corrosive water soluble salt.

The vacuum pressure source 212 is in fluid communication with the second buffer chamber 218-2 and, when operating, maintains the second buffer chamber 218-2 at a vacuum pressure. The vacuum pressure source 212 could be implemented using any one of numerous systems and devices for maintaining the second buffer chamber 218-2 at a vacuum pressure; however, in the depicted embodiment the vacuum pressure source 212 is implemented using a vacuum pump 232. The vacuum pump 232 includes at least an inlet 234 and an outlet 236. The vacuum pump inlet 234 is in fluid communication with the second buffer chamber 218-2, and the vacuum pump outlet 236 is in fluid communication with an environment external to the second buffer chamber 218-2, preferably via a check valve 237. It will be appreciated this external environment may be, for example, the surrounding seawater environment 114, a chamber external to or within the hull 108, or the interior of the hull 108. In any case, the vacuum pump 232 is configured, when operating, to maintain the second buffer chamber at the vacuum pressure. Thus, any buffer fluid that may leak past the second seal 206-2 will boil, and be unable to traverse further into the actuator housing 202. Similar to the pressurized buffer fluid source 208, the vacuum pressure source 212 is preferably mounted on the actuator housing 202, though this is merely exemplary and could be mounted remote from the actuator housing 202.

In addition to the above, the depicted actuator 110 further includes a pressure reservoir 238, and may further include one or more sensors 242, 244. The pressure reservoir 238, which is in fluid communication with the first buffer chamber 218-1, maintains the pressure in the first buffer chamber 218-1 above that of the surrounding seawater environment 114 when the actuator 110, and/or the system of which the actuator 110 forms a part, is shutdown or is being shutdown. It will be appreciated that the pressure reservoir 238 may be implemented using any one of numerous devices and configurations. For example, the pressure reservoir 238 may be implemented using a pressure bladder, an accumulator, or a pressurized volume of fluid, just to name a few.

As noted above, the actuator 110 may further include one or more sensors 242, 244. In the depicted embodiment the actuator 110 includes two sensors—a first buffer chamber sensor 242, and a second buffer chamber sensor 244. It will be appreciated that this is merely exemplary, and that the actuator 110 could be implemented with more or less than this number of sensors, with more or less than this number of sensors per buffer chamber 218, or with no sensors at all. Nonetheless, the first buffer chamber sensor 242, if included, is preferably configured to sense a parameter representative of a fault with the first seal 206-1, and may be configured as any one of numerous types of suitable sensors. For example, the first buffer chamber sensor 242 may be an electrical conductivity sensor that is configured to sense the electrical conductivity of the pressurized buffer fluid in the first buffer chamber 218-1 as an indicator of seawater ingress. Alternatively, the first buffer chamber sensor 242 could be configured to sense the presence of one or more chemicals or ions that are typically present in seawater or other corrosive fluid in the surrounding environment 114.

The second buffer chamber sensor 244 is preferably configured to sense a parameter representative of a fault with the second seal 206-2 and, similar to the first buffer chamber sensor 242, may be configured as any one of numerous types of suitable sensors. One exemplary sensor type that may be used as the second buffer chamber sensor 244 is a pressure sensor. With a pressure sensor, a lack of sensed vacuum pressure in the second buffer 218-2 would be representative of a fault with the second seal 206-1. Moreover, if the second buffer chamber pressure is sensed to be equal to the surrounding environment 114, this would be representative of a fault with the first and second seals 206-1, 206-2.

In the embodiment depicted in FIG. 1, the third seal 206-3 is depicted in phantom. This is done because, as was mentioned above, the actuator 110 may be implemented without the third seal 206-3 in some alternative embodiments. For example, and with reference now to FIG. 3, an actuator 300 that does not include the third seal 206-3 is depicted. In this exemplary embodiment, the actuator 300 is implemented as an electromechanical linear actuator, such as a ballscrew-type actuator. The actuator 300, in addition to including many of the previously described devices and components (which are referenced using like reference numerals), includes a motor 302 and an actuation member 304.

The motor 302 is disposed in motor cavity 306 that is defined by a motor housing 308, and is coupled to the actuation member 304. The motor 302, upon being appropriately energized, supplies a rotational input force to the actuation member 304. The actuation member 304 is coupled between the motor 302 and the translation member 204, and receives the rotational input force supplied from the motor 302. The actuation member 304, in response to the rotational input force, rotates and supplies the drive force to the translation member 204, which causes the translation member 204 to translate. It will be appreciated that the motor housing 308 may be formed as an integral part of the actuator housing 202, or separately coupled thereto. In either case it is seen that the motor housing 308 defines at least a portion of the second buffer chamber 218-2. Thus, as FIG. 3 further depicts, the vacuum pressure source 212 maintains a vacuum pressure both in the second buffer chamber 218-2 and the motor cavity 306.

Figure 3:
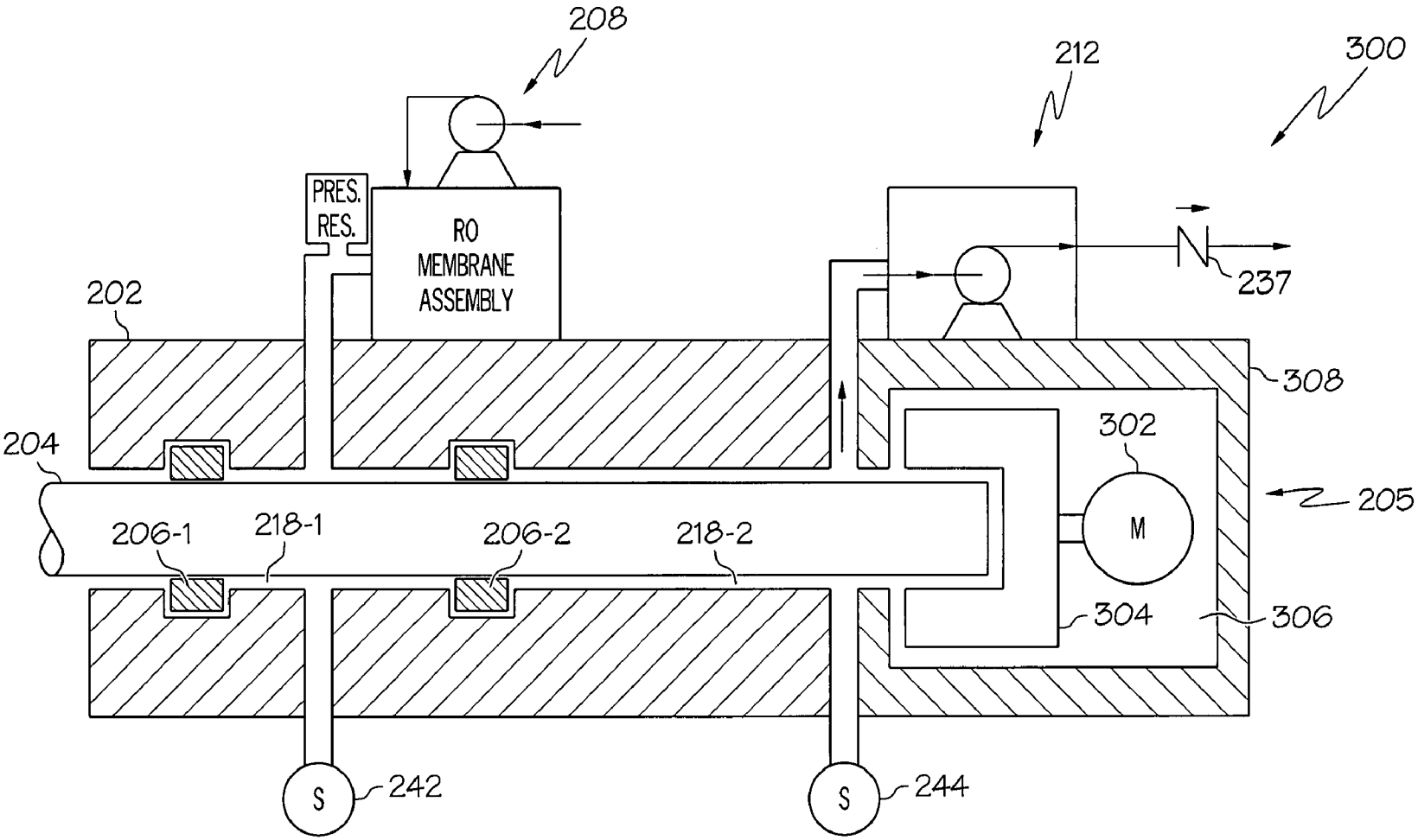

Before proceeding further, it is noted that the actuator depicted in FIG. 3 was described as being configured as an electromechanical actuator. Thus, the motor 302 was appropriately referenced as an electric motor. It will be appreciated, however, that in other embodiments, the motor 302 could be implemented as either a pneumatic motor or a hydraulic motor, if need or desired.

Figure 4:
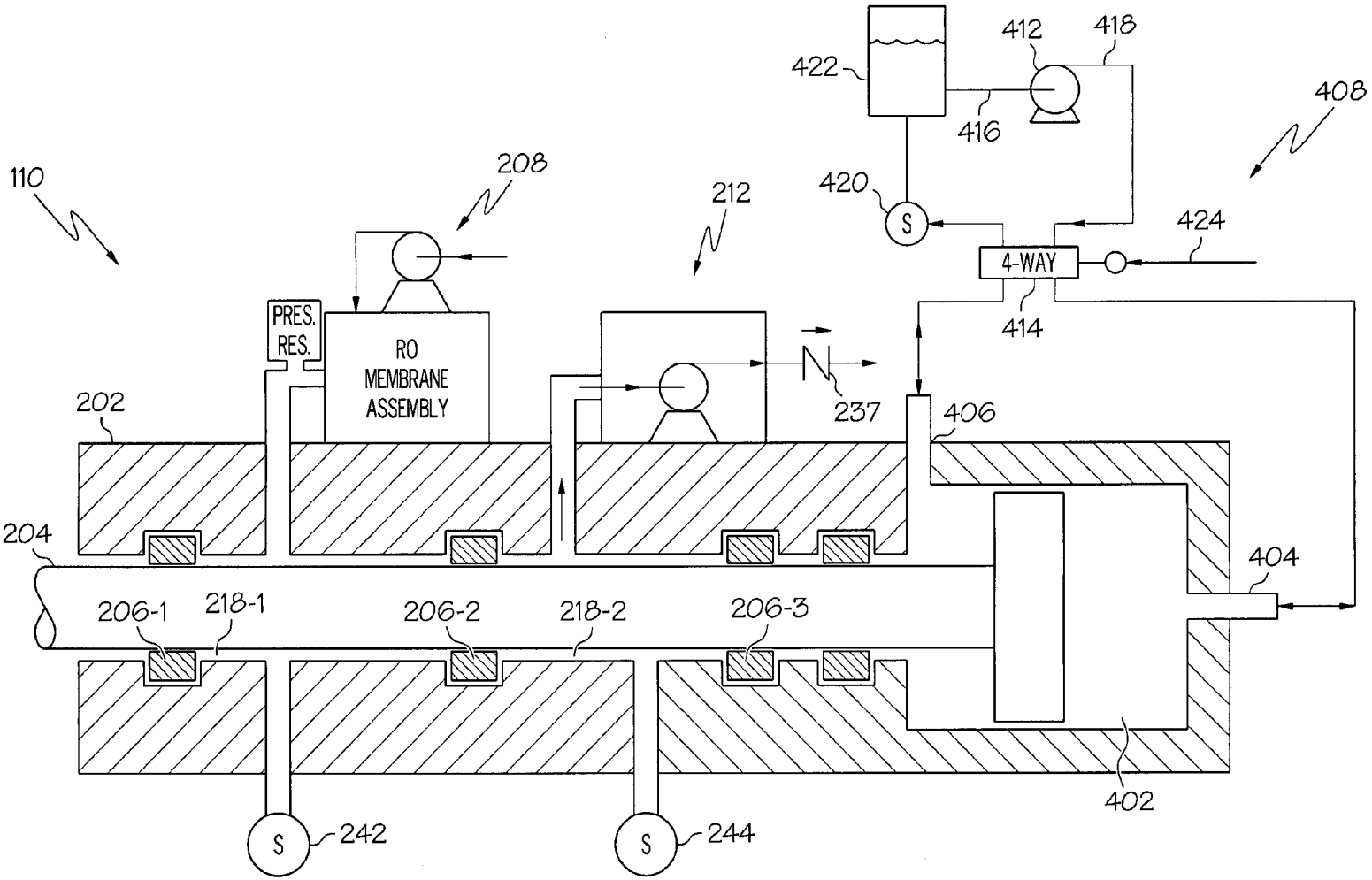

Turning now to FIG. 4, yet another alternative embodiment is depicted and will be described. In this alternative embodiment the drive force supply source 205 is a pressurized fluid. Although the pressurized fluid may vary, and may be any one of numerous types of gases or liquids, in the depicted embodiment, the pressurized fluid is preferably a hydraulic fluid. Thus, as FIG. 4 depicts, the actuator housing 202 defines a fluid cavity 402 within which a portion of the translation member 204 is disposed. The fluid cavity 402 includes a first fluid port 404 and a second fluid port 406, both of which are coupled to a pressurized fluid source 408.

The pressurized fluid source 408 is configured to selectively supply pressurized fluid to the fluid cavity 402 via one of the fluid ports 404, 406, and to receive fluid discharged from the other fluid port 406, 404. The fluid port 404, 406 which fluid is supplied to and received from depends upon whether the translation member 204 is to be translated in the first direction 214 or the second direction 216. For example, if it is desired to translate the translation member in the first direction 214, pressurized fluid is supplied to the fluid chamber 402 via the first fluid port 404, and is discharged therefrom via the second fluid port 406. Conversely, if it is desired to translate the translation member in the second direction 216, pressurized fluid is supplied to the fluid chamber 402 via the second fluid port 406, and is discharged therefrom via the first fluid port 404.

Although the pressurized fluid source 408 may be implemented according to any one of numerous configurations to pressurize and control the flow of hydraulic fluid to and from the fluid cavity 402, in the depicted embodiment the pressurized fluid source 408 is implemented using a hydraulic pump 412, a flow control valve 414, and a sensing system 420. The hydraulic pump 412 includes a fluid inlet 416, which is in fluid communication with a hydraulic fluid source 422, and a fluid outlet 418, which is in fluid communication with the flow control valve 414. The hydraulic pump 412, when operating, draws hydraulic fluid from the hydraulic fluid source 422, and discharges the hydraulic fluid out the fluid outlet 418 at a higher fluid pressure.

The flow control valve 414 is adapted to receive, or at least selectively receive, flow control signals 424 from a non-illustrated control circuit. In response to the flow control signals, the flow control valve 414 is positioned to direct the pressurized hydraulic fluid that is discharged from the hydraulic pump 412 into either the first fluid port 404 or the second fluid port 406, and to direct the hydraulic fluid discharged from either the second fluid port 406 or the first fluid port 404, respectively, back to the hydraulic fluid source 422. It will be appreciated that the flow control valve 414 may be implemented using any one of numerous devices to implement its function. In the depicted embodiment, however, the flow control valve 414 is implemented using a four-way valve.

With the depicted configuration, if the translation member 204 is to be moved in the first direction 214, then the flow control valve 414 will be positioned such that hydraulic fluid discharged from the hydraulic pump 412 is directed into the first fluid port 404. The fluid pressure entering the fluid chamber 402 via the first fluid port 404 will force the translation member 204 in the first direction 214, and will also cause fluid that is displaced from the fluid chamber 402 to be discharged therefrom via the second fluid port 406. The flow control valve 414 will direct this fluid back to the hydraulic fluid source 422. Conversely, if the translation member 204 is to be moved in the second direction 216, then the flow control valve 414 will be positioned such that hydraulic fluid discharged from the hydraulic pump 412 is directed into the second fluid port 406. The fluid pressure entering the fluid chamber 402 via the second fluid port 406 will force the translation member 204 in the second direction 216, and will also cause fluid that is displaced from the fluid chamber 402 to be discharged therefrom via the first fluid port 404. The flow control valve 414 will direct this fluid back to the hydraulic fluid source 422.

As FIG. 4 additionally depicts, the actuator 110 may include, if needed or desired, a fourth seal 206-4. The fourth seal 206-4, if included, may be the same type or a different type of seal that is used to implement the other seals 206-1, 206-2, 206-3. Moreover, and as was previously mentioned, the hydraulic fluid source 408 further includes a sensing system 420. The sensing system 420, which may be implemented using a low pressure vacuum water separator chamber, is configured to separate any water constituent that may infiltrate the hydraulic fluid. The sensing system 420 can provide an indication of a fault in one or more of the seals 206, based on the amount of water that is separated from the hydraulic fluid. Alternatively, the sensing system 420 could be configured to sense the concentration of salt or other impurity within the hydraulic fluid.

The actuator 110 configurations depicted and described herein, which are merely examples of various preferred embodiments, each at least inhibit the deleterious effects of corrosive fluids, such as seawater. The actuators 110 do not rely on relatively expensive materials, and are capable of operation and relatively high pressures.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An actuation system, comprising:

an actuator housing;

a translation member disposed at least partially within, and at least partially movable into and out of, the housing, the translation member adapted to receive a drive force and operable, upon receipt thereof, to translate in either a first direction or a second direction;

a plurality of seals disposed between the actuator housing and the translation member, the plurality of seals defining at least a first buffer chamber and a second buffer chamber;

a reverse osmosis system in fluid communication with the first buffer chamber and operable to supply a pressurized buffer fluid thereto; and a vacuum pressure source in fluid communication with the second buffer chamber, to thereby maintain the second buffer chamber at least at a vacuum pressure.

2. The actuation system of claim 1, wherein the reverse osmosis system comprises:

a reverse osmosis pump having a fluid inlet and a fluid outlet, the reverse osmosis pump operable to draw fluid from a first fluid source at a first pressure into the fluid inlet and discharge pressurized fluid at a second, higher pressure; and a reverse osmosis membrane assembly in fluid communication between the reverse osmosis pump fluid outlet and the first buffer chamber, the reverse osmosis membrane assembly operable to remove a solute from the pressurized fluid.

3. The actuation system of claim 1, wherein the reverse osmosis system is at least partially mounted on the actuator housing.

4. The actuation system of claim 1, wherein the vacuum pressure source comprises:

a vacuum pump having at least an inlet in fluid communication with the second buffer chamber, the vacuum pump operable to maintain the second buffer chamber at least at the vacuum pressure.

5. The actuation system of claim 4, wherein the vacuum pump is mounted on the actuator housing.

6. The actuation system of claim 1, further comprising:

a first buffer chamber sensor coupled to the actuator housing and configured to sense a parameter representative of the presence of a corrosive fluid in the first buffer chamber.

7. The actuation system of claim 1, further comprising:

a second buffer chamber sensor coupled to the actuator housing and configured to sense second buffer chamber pressure.

8. The actuation system of claim 1, further comprising:

an actuation member coupled to the translation member, the actuation member adapted to receive a rotational input force and configured, upon receipt thereof, to supply the drive force to the translation member.

9. The actuation system of claim 8, further comprising:

a motor coupled to the actuation member and operable to selectively supply the rotational input force thereto; and a motor housing surrounding at least a portion of the motor and at least partially defining the second buffer chamber.

10. The actuation system of claim 1, wherein:

the actuator housing defines a hydraulic fluid chamber, the hydraulic fluid chamber adapted to receive hydraulic actuation fluid and in fluid communication with at least a portion of the translation member; and the hydraulic actuation fluid supplies the drive force to the translation member.

11. The actuation system of claim 10, further comprising:

a hydraulic fluid pump in fluid communication with the hydraulic fluid chamber and operable to supply a flow of the hydraulic actuation fluid into and through the hydraulic fluid chamber; and a sensing system disposed between the hydraulic chamber and the hydraulic fluid pump and operable to sense the presence of moisture in the hydraulic fluid.

12. The actuation system of claim 11, wherein the sensing system is configured to sense a parameter representative of an amount of water in the hydraulic fluid.

13. The actuation system of claim 11, wherein the sensing system is configured to sense an amount of water separated from the hydraulic fluid.

14. The actuation system of claim 11, wherein the sensing system is configured to sense an amount of salt in the hydraulic fluid.

15. An actuation system, comprising:

an actuator housing;

a translation member disposed at least partially within, and at least partially movable into and out of, the housing, the translation member adapted to receive a drive force and operable, upon receipt thereof, to translate in either a first direction or a second direction;

a plurality of seals disposed between the actuator housing and the translation member, the plurality of seals defining at least a first buffer chamber and a second buffer chamber; and a reverse osmosis system at least partially mounted on the actuator housing, the reverse osmosis system in fluid communication with the first buffer chamber and operable to supply a pressurized buffer fluid thereto.

16. An unmanned underwater vehicle (UUV), comprising:

a hull;

a plurality of control surfaces movably disposed on the hull; and a plurality of actuators coupled to the hull, each actuator further coupled to one or more of the control surfaces and configured to selectively move the control surfaces, each actuator including:

an actuator housing coupled to the hull, a translation member coupled to a control surface and disposed at least partially within, and at least partially movable into and out of, the housing, the translation member adapted to receive a drive force and operable, upon receipt thereof, to translate in either a first direction or a second direction, a plurality of seals disposed between the actuator housing and the translation member, the plurality of seals defining at least a first buffer chamber and a second buffer chamber, a reverse osmosis system in fluid communication with the first buffer chamber and operable to supply a pressurized buffer fluid thereto, and a vacuum pressure source in fluid communication with the second buffer chamber, to thereby maintain the second buffer chamber at least at a vacuum pressure.

17. The UUV of claim 16, wherein the reverse osmosis system comprises:

a reverse osmosis pump having a fluid inlet and a fluid outlet, the reverse osmosis pump operable to draw fluid from a first fluid source at a first pressure into the fluid inlet and discharge pressurized fluid at a second, higher pressure; and a reverse osmosis membrane assembly in fluid communication between the reverse osmosis pump fluid outlet and the first buffer chamber, the reverse osmosis membrane assembly operable to remove a solute from the pressurized fluid.

18. The UUV of claim 16, wherein the vacuum pressure source comprises:

a vacuum pump having at least an inlet in fluid communication with the second buffer chamber, the vacuum pump operable to maintain the second buffer chamber at least at the vacuum pressure.

* * * * *